United States Patent [19]

Mitchell et al.

[11] Patent Number: 4,926,639

[45] Date of Patent: May 22, 1990

[54] SIBLING CYCLE PISTON AND VALVING METHOD

[75] Inventors: Matthew P. Mitchell, Berkeley; Luc Bauwens, Oakland, both of Calif.

[73] Assignee: Mitchell/Sterling Machines/Systems, Inc., Berkeley, Calif.

[21] Appl. No.: 420,669

[22] Filed: Oct. 10, 1989

Related U.S. Application Data

[63] Continuation of Ser. No. 300,855, Jan. 24, 1989, abandoned.

[51] Int. Cl.[5] ..... F02G 1/04

[52] U.S. Cl. ..... 60/522; 60/517; 60/526

[58] Field of Search ..... 60/517, 522, 526

[56] References Cited

U.S. PATENT DOCUMENTS 4,622,813 11/1986 Mitchell .
4,805,408 2/1989 Beale et al. .

OTHER PUBLICATIONS

Gasser, M. G., Sherman, S. and Beale, W., "Developments Toward Achievement of a 3-5 Year Lifetime Stirling Cycle Refrigerator for Space Applications", (Publication date and source uncertain, but probably early 1980's).

West, Colin D., *Principles and Applications of Stirling Engines*, Van Nostrand Rheinhold, (New York 1986), p. 91.

Vincent, Ronald J., Rifkin, William D., & Benson, Glendon M., "Test Results of High Efficiency Stirling Machine Components", 17th IECEC, Paper 829362, (198).

Walker, G., *Stirling Engines*, Clarendon (Oxford, 1980), p. 116.

Philips Laboratories, "Design for Fabrication of a Long-Life Stirling Cycle Cooler for Space Application", Prepared for NASA Goddard Space Flight Center, Final Report for period Sep. 1978-Dec. 1982, Contract NAS5-25172, (Mar. 1983).

Stolfi, F., "Final Report for Parametric Testing of Engineering Model Refrigerator", Prepared for NASA Goddard Space Flight Center, Contract No. NAS-5-26688.

Lilly, L. R. C., *Diesel Engine Reference Book*, Butterworths (London 1985, p. 10/7.

*Primary Examiner*—Allen M. Ostrager
*Attorney, Agent, or Firm*—Limbach, Limbach & Sutton

[57] ABSTRACT

A double-acting, rotating piston reciprocating in a cylinder with the motion of the piston providing the valving action of the Sibling Cycle through the medium of passages between the piston and cylinder wall. The rotating piston contains regenerators ported to the walls of the piston. The piston fits closely in the cylinder at each end of the cylinder except in areas where the wall of the cylinder is relieved to provide passages between the cylinder wall and the piston leading to the expansion and compression spaces, respectively. The piston reciprocates as it rotates. The cylinder and piston together comprise an integral valve that seqentially opens and closes the ports at the ends of the regenerators alternately allowing them to communicate with the expansion space and compression space and blocking that communication. The relieved passages in the cylinder and the ports in the piston are so arranged that each regenerator is sequentially (1) charged with compressed working gas from the compression space; (2) isolated from both expansion and compression spaces; (3) discharged of working gas into the expansion space; and (4) simultaneously charged with working gas from the expansion space while being discharged of working gas into the compression space, in the manner of the Sibling Cycle. In an alterate embodiment, heat exchangers are external to the cylinder and ports in the cylinder wall are alternately closed by the wall of the piston and opened to the expansion and compression spaces through relieved passages in the wall of the reciprocating, rotating piston.

7 Claims, 5 Drawing Sheets

SIBLING CYCLE PISTON AND VALVING METHOD

U.S. GOVERNMENT RIGHTS

This invention was made with Government support under Contract No. NAS3-25456 awarded by NASA. The Government has certain rights in this invention.

This is a continuation of co-pending application Ser. No. 300,855 filed on 1/24/89, now abandoned.

TECHNICAL FIELD

The present invention is related to hot gas engines and heat pumps. In particular, the present invention is directed to a device for achieving the Sibling Cycle variant of the Stirling/Ericsson type of regenerative cycle using a piston that simultaneously reciprocates and rotates in a cylinder to change the volume of chambers in response to reciprocation and to provide control valve functions in response to rotation.

BACKGROUND ART

The regenerative cycle executed by the machine described in U.S. Pat. No. 4,622,813, issued to Matthew P. Mitchell, co-inventor of the invention claimed herein, has come to be known as the "Sibling Cycle". That cycle may be employed in engines in which heat energy is converted into mechanical energy or in refrigerators/heat pumps in which mechanical energy is put into the machine and heat is transferred from one part of the machine to another. The machine described in that patent has theoretical advantages over other machines that employ variations of the Stirling and Ericsson cycles both in terms of mechanical simplicity and in the manner in which thermodynamic processes are carried out.

In the Sibling Cycle, two or more volumes of working gas are each sequentially subjected to the basic steps of a Stirling or Ericsson cycle. That is, first the working gas is compressed in a compression chamber and heat generated by that compression is removed from the compressed gas and rejected from the machine. The working gas is allowed to expand into an expansion chamber where it cools, and the cool, expanded gas absorbs heat. The working gas is then returned to the compression chamber to repeat the cycle. Typically, the working gas passes through a regenerator in one direction in one part of the cycle and in the other direction in another part of the cycle. This is true of the Sibling Cycle as well.

To accomplish the Sibling Cycle, the machine described in U.S. Pat. No. 4,622,813 requires at least four valves, the operation of which must be synchronized with the piston motion. Ordinary types of valves require complex mechanical or electrical arrangements to open and close them at the proper times. If the valves are separately actuated, then there is a possibility of independent failure of one valve, with possibly serious consequences. The valves must provide a good seal against pressure from first one direction and then the other. Sealing a rapidly opening and closing bi-directional valve is a difficult technical problem.

High-performance Stirling cycle engines have normally employed external heat exchangers in addition to regenerators in order to absorb heat and reject heat. External heat exchangers are expensive and add bulk and weight. Since the previously-known Sibling Cycle machine requires at least two sets of heat exchangers, each controlled at each end by valves, the burdens of cost, bulk and weight are increased if the usual type of external heat exchangers is employed.

Crank-driven Sibling, Stirling and Ericsson machines require crankshafts, connecting rods, cross-heads and piston rods. Free-piston Stirling machines do not require these moving parts, but do require separate pistons and displacers, together with gas spring bounce spaces to accommodate the motion of the pistons. These machines require at least one piston and one displacer to accomplish their thermodynamic cycle. The gas-spring bounce space generates irreversible heat transfers, reducing efficiency.

SUMMARY OF THE INVENTION

One embodiment of the present invention eliminates the need for valve drive train components, external heat exchangers, crankshafts, connecting rods, cross-heads and piston rods in a machine that requires no bounce space and only a single piston to accomplish a thermodynamic cycle that closely approximates the ideal Stirling cycle. An embodiment employing an exclusively electrical drive accomplishes the cycle with just one moving part, which is at least one moving part less than is required by any other known machine that executes a Stirling or Ericsson cycle.

These beneficial effects are accomplished by an arrangement of piston and cylinder in which regenerators are embedded in the piston and ported to the walls of the piston at each end. As the piston moves back and forth in the cylinder, it also rotates. The cylinder and piston fit closely at each end, except in portions of the cylinder that are relieved so as to provide passages between the cylinder wall and piston. Those passages are located so that, as the piston rotates, the passages periodically allow communication between ports in the piston and the spaces at each end of the cylinder.

By adjusting the relationship between the reciprocation of the piston and its rotation, the piston and cylinder become an integral valve, opening and closing the ports in the piston in the sequence required to execute the Sibling Cycle. Several alternative methods of synchronizing the rotation of the piston with its reciprocation are possible.

Isothermalizing rings have been previously conceived for use in Stirling machines. They are concentric rings, alternately mounted on the end of a piston and on the corresponding cylinder head so that they mesh, with a small clearance, and move in and out relative to each other as the piston reciprocates. They increase the heat transfer area of both the cylinder head and the piston. They thus tend to reduce the deviation of gas temperature from wall temperature in the cylinder, reducing irreversible heat transfer and improving efficiency.

Isothermalizers depend upon both increased area and increased gas velocity to improve heat transfer. The increased velocity is a consequence of the lengthened path that the working gas must travel in and out of the isothermalizing rings and of the shearing action of the meshing rings relative to each other as the piston reciprocates.

By rotating the reciprocating piston, the present invention combines the shearing action of piston rotation with the shearing action of the reciprocal meshing of the isothermalizers, significantly increasing their effectiveness.

In another embodiment of the invention, the wall of the cylinder contains valve ports and the piston is relieved to provide passages between the ports and the expansion and compression spaces, respectively. In this version, the piston does not contain the regenerators and the working gas passes between the two ends of the cylinder through heat exchanger assemblies that are external to the cylinder.

Thus, it is an object of the present invention to provide an improved Sibling Cycle machine in which a rotating reciprocating piston interacts with the cylinder in which it rotates to provide an integral, synchronized valving system that accomplishes the valving sequence of the Sibling Cycle.

A further object of the present invention is to provide an improved Sibling Cycle machine employing a reduced number of moving parts.

A further object of the present invention is to provide an improved free piston Sibling Cycle machine which is hermetically sealed and electrically driven.

A further object of the present invention is to provide an improved Sibling Cycle machine in which two sets of regenerators are embedded in a double-acting, rotating piston that serves as part of the valve mechanism of the machine.

A further object of the present invention is to provide an improved Sibling Cycle machine in which a rotating, reciprocating piston equipped with carved recessed areas at both ends provides an integral valving mechanism for external heat exchangers.

A further object of the present invention is to provide an integral valving system for Sibling Cycle machines in which the valve mechanism includes the piston and in which the piston is at all times balanced with respect to lateral forces acting upon it as a result of its participation in the valving system.

A further object of the present invention is to improve the performance of isothermalizers by attaching them to a rotating piston.

Further objects and advantages of the invention will be apparent from the drawings and description that follow.

DETAILED DESCRIPTION OF THE INVENTION

Figure 1:
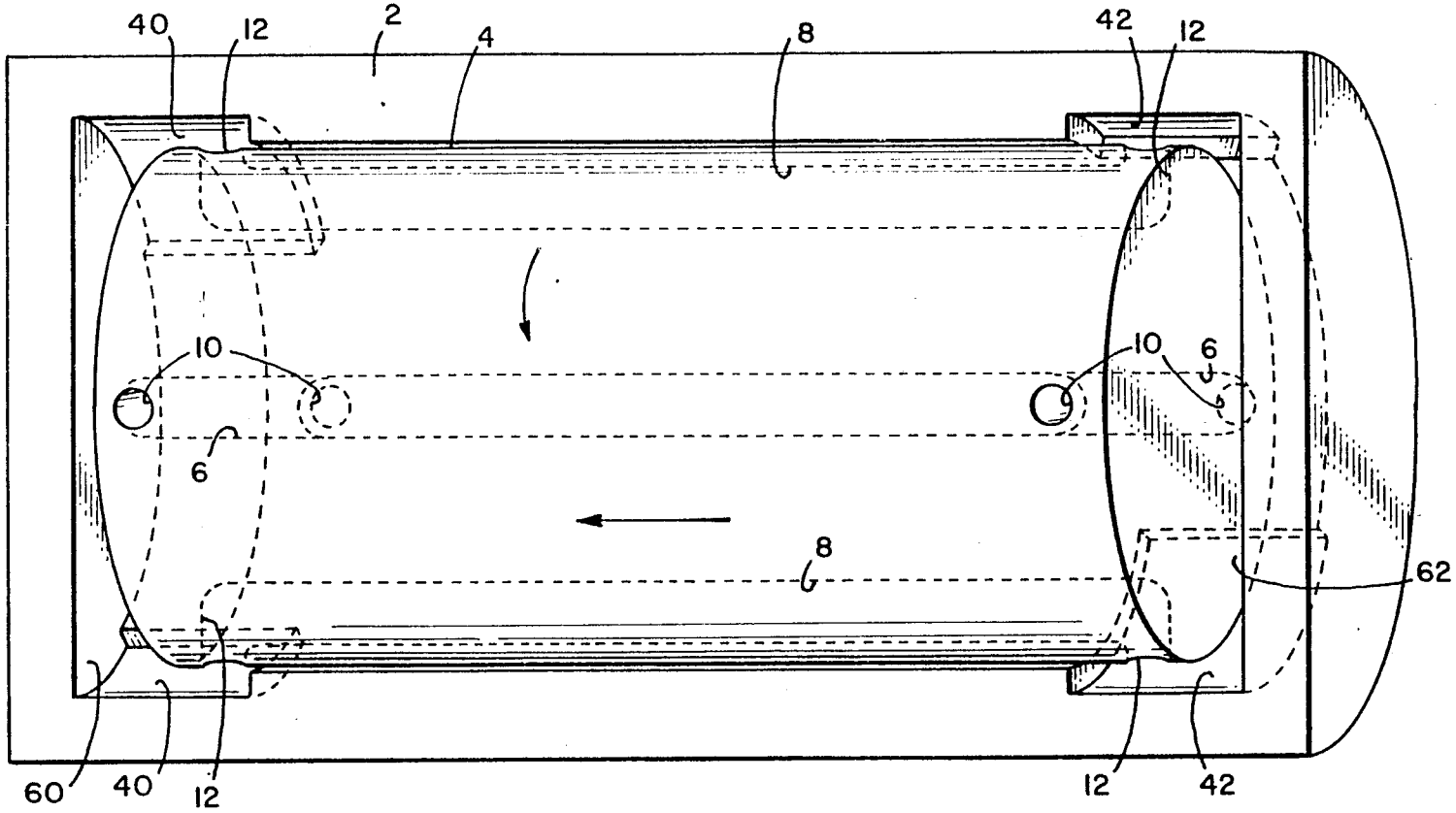
FIG. 1 illustrates a rotating double-acting piston containing regenerators that are ported to the side walls of the piston fitted in a closed cylinder that is fashioned with relieved passages at the ends of its inside walls.

FIG. 1 illustrates a double-acting piston 4 containing two sets of regenerators 6, 8, designated the "A" regenerators 6 and the "B" regenerators 8. As illustrated, there are two "A" regenerators and two "B" regenerators. The regenerators 6, 8 are arranged radially around the central axis of the piston 4. Each regenerator is equipped at each end with ports 10, 12, opening to the wall of a cylinder 2.

Figure 2:
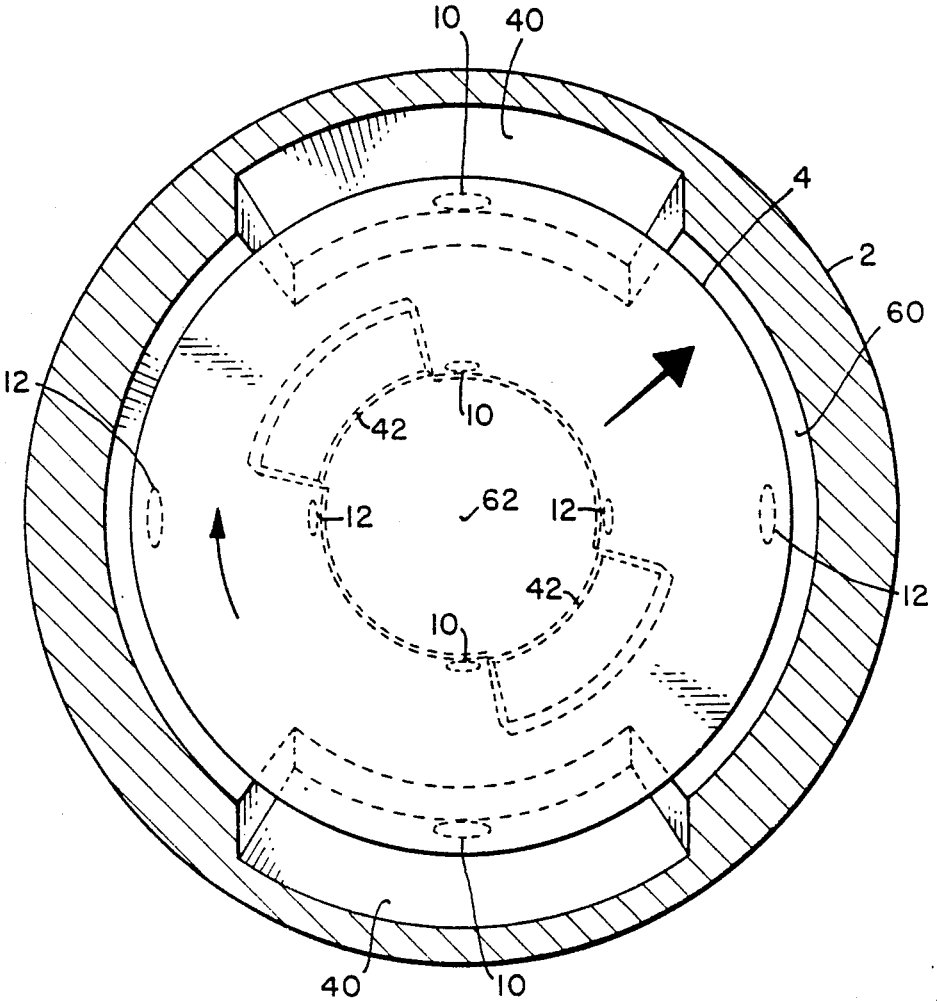
FIG. 2 illustrates the relationship of regenerator ports and relieved passages in cylinder walls, seen in perspective from the end of the cylinder.

FIG. 2 is a perspective view of the cylinder 2 showing the piston 4 end-on without cylinder heads. It illustrates recessed areas 40, 42 in the wall of the cylinder 2, arranged so that if the piston 4 is rotated, first the "A" regenerator ports 10 and then the "B" regenerator ports 12 will be opposite those recessed areas, in a regular alternation. The recessed areas 40, 42 are so shaped and located that it is not possible for any portion of the "A" ports 10 to be opposite a recessed area 40 or 42 at the same time that "B" ports 12 are opposite those recessed areas at the same end of the machine. The recessed areas create passages between the piston 4 and the wall of the cylinder 2, communicating between regenerator ports 10 or 12 and an expansion chamber 60 and compression chamber 62, respectively. The piston/cylinder contact thus serves as the valves required for the operation of the Sibling Cycle, as described in greater detail below.

Figure 3:
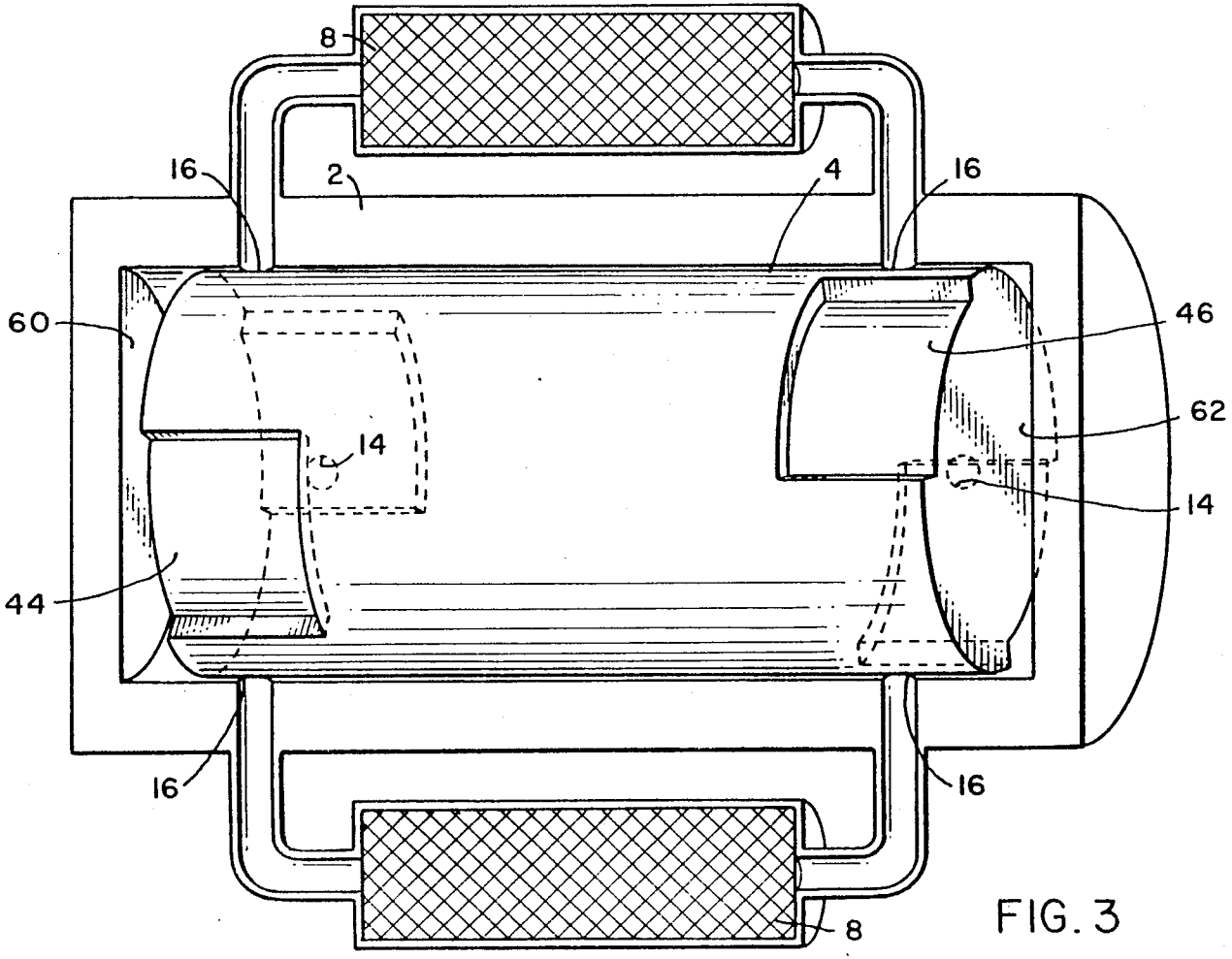
FIG. 3 illustrates a rotating, reciprocating piston with carved recesses at each end and ports in the cylinder walls.

FIG. 3 illustrates a double-acting piston 4 with recessed areas 44, 46 formed in each end. The piston 4 rotates and reciprocates in a cylinder 2. As the piston 4 rotates, the recessed areas 44, 46 in it walls cyclically pass over ports 14, 16 in the walls of the cylinder 2, momentarily opening a channel of communication between those ports 14, 16 and the expansion space 60 or the compression space 62, as the case may be. The ports in the cylinder wall lead to heat exchanger assemblies 8 of the type usually utilized for a Sibling Cycle machine. The valving sequence is the same as the case in which the regenerators are inside the piston and the ports are in the piston wall.

Figure 4:
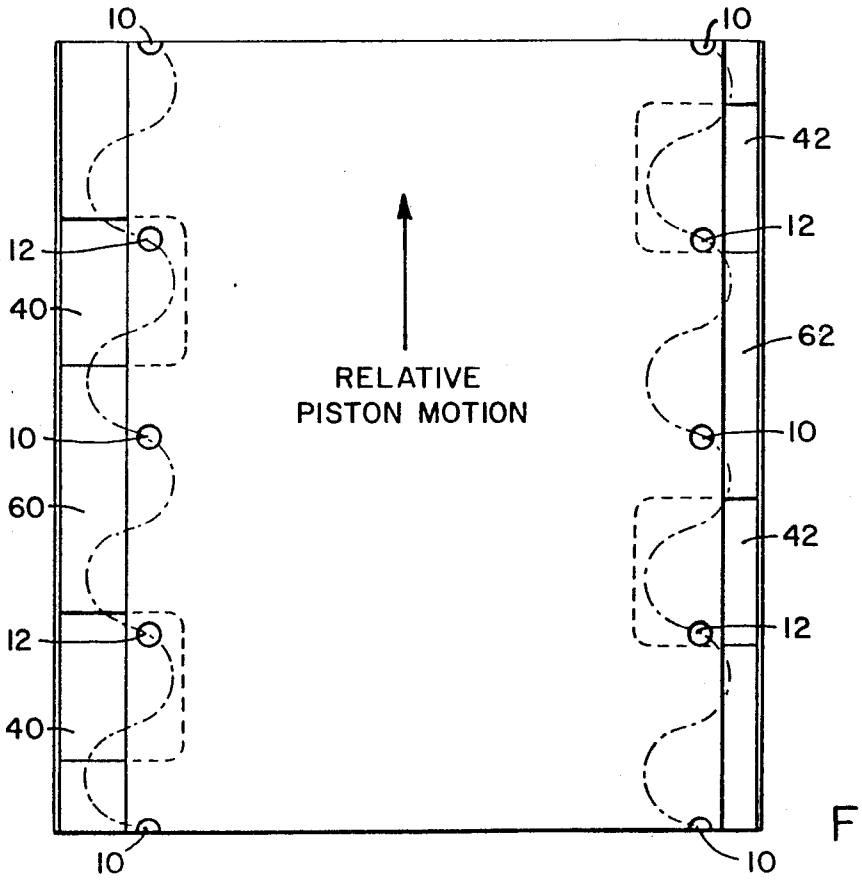
FIG. 4 illustrates the surfaces of a ported, rotating, reciprocating piston, and the cylinder in which the piston moves, unrolled.

FIG. 4 is an unrolled view of the surfaces of the piston and cylinder wall of FIG. 1. FIG. 4 shows how recessed areas of the cylinder wall interact with the regenerator ports in the rotating piston to produce the valving action required for the Sibling Cycle. The reference numbers in FIG. 4 have the same meanings as in FIG. 1.

Figure 5:
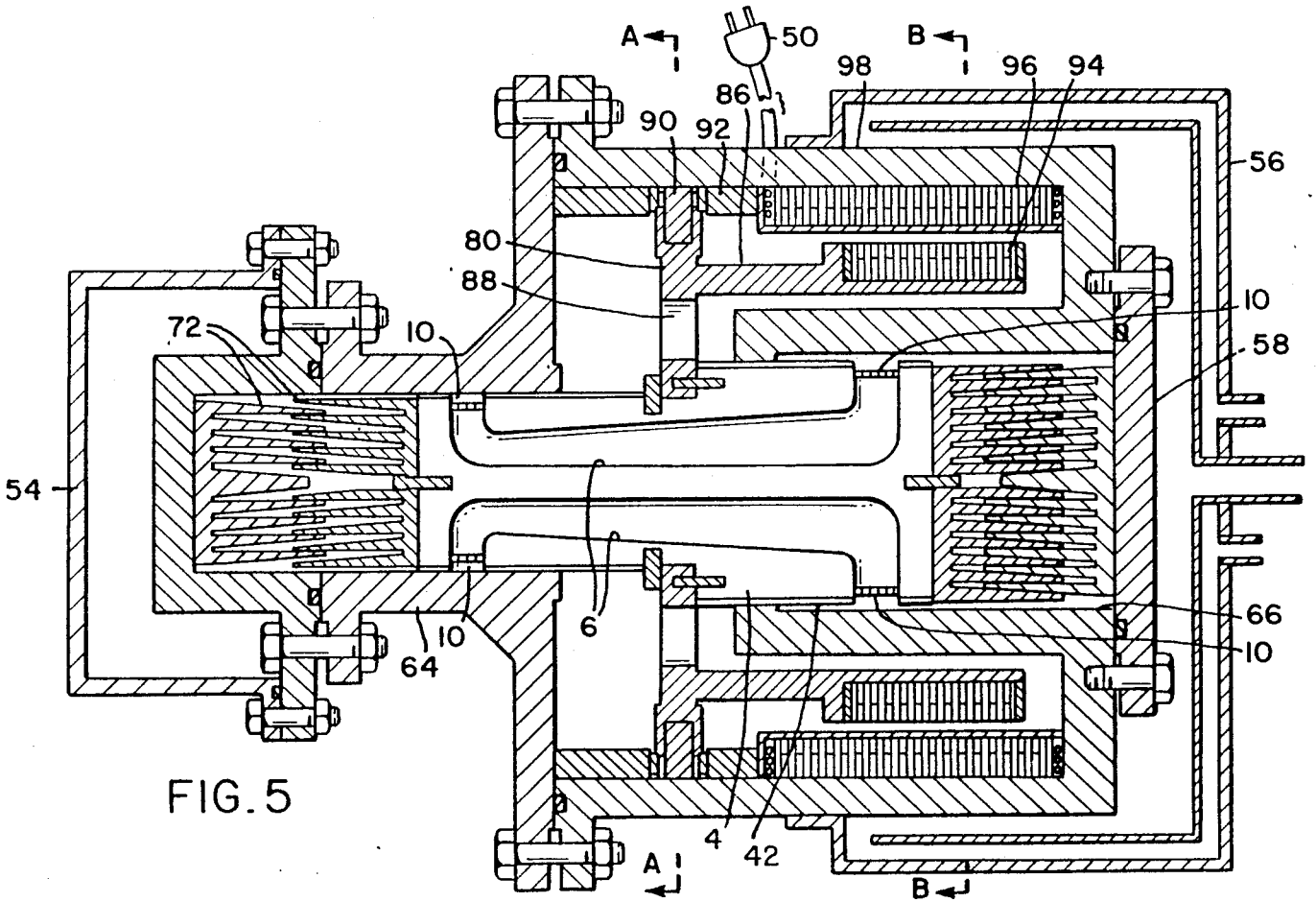
FIG. 5 illustrates an electrical/mechanical drive mechanism for a rotating, reciprocating piston.

FIG. 5 illustrates an electrical/mechanical refrigerator drive arrangement in which the rotation of the piston 4 is produced electrically by an induction-type motor in which a rotor ring 86 attached to the piston 4 carries the rotor windings 94, and the stator windings 96 are arranged radially around the housing 98. The electric motor rotates the rotor ring 86 which transmits that motion through the spider 80 to the piston 4.

Reciprocal translation of the piston 4 is controlled by a cam arrangement. Cam followers 90 mounted in the spider 80 traverse cam profiles cut in the sides of hardened rings 92 attached to the housing 98. If four regenerators 6, 8 are used in the cylinder, then the cams 92 should be cut so that the piston 4 makes four back-and-forth traverses for each rotation. That is because each Sibling cycle requires two back and forth reciprocations of the piston and each rotation of the piston produces the valve action required for 2 cycles.

As shown in FIG. 5, the spider 80 is perforated to permit the working gas to pass through it as it reciprocates.

The drive arrangement shown in FIG. 5 puts the drive elements necessary to create rotating and reciprocating motion inside the same hermetically sealed housing with the piston. It would be possible to achieve the same mechanical motion by connecting the piston to a piston-rod and passing the piston rod (not shown) through a seal (not shown) in cylinder head 58 to an external mechanism (not shown) that generates the necessary reciprocating, rotating motion of the piston rod with cranks and gears in known ways.

Alternatively, it is also possible to eliminate the cams shown in FIG. 5 by combining a rotary electrical drive shown with a linear electrical drive (not shown) to produce the necessary reciprocating, rotating piston motion.

In the machine illustrated in FIGS. 1, 2 and 5, the space in the cylinder 2 is divided by the piston 4 into an expansion space and a compression space. When the machine is run as a heat pump (including refrigerators and cryocoolers in the definition of "heat pump"), the compression space is internally heated by compression of a compressible working gas confined in the cylinder and externally cooled; the expansion space is simultaneously cooled internally by expansion of the working gas and externally heated by a heat source that is in turn cooled by that heat transfer.

To maximize the portion of the piston 4 that can be used to house cylindrically-shaped regenerators, four regenerators is an appropriate number. Moreover, with four regenerators, the two "A" regenerator ports may be placed on opposite sides of the piston from each other and the two "B" regenerator ports may be placed on opposite sides of the piston from each other. In this way, the side forces generated by compressed gas in the regenerators is axially balanced, reducing the friction between the piston and the cylinder walls.

In order to make the cycle work, the ports at the ends of the regenerators must be open and closed in the usual Sibling Cycle sequence, as follows:

| Piston | Expansion Space End | | Compression Space End | |
|---|---|---|---|---|
| Motion | "A" Ports | "B" Ports | "A" Ports | "B" Ports |
| Toward (62) | Open | Closed | Closed | Open |
| Toward (60) | Open | Closed | Open | Closed |
| Toward (62) | Closed | Open | Open | Closed |
| Toward (60) | Closed | Open | Closed | Open |

Although it is important that "A" and "B" ports not both be open at the same time at the same end of the machine, it is also important that both "A" and "B" ports not both be closed at the same end of the machine at the same time except as is necessary to completely close one set of ports and adjust cylinder pressure before the other set of ports is opened. This will require careful placement of the relieved areas of the cylinder wall 40, 42 as well as proper synchronization of rotary and reciprocating motion.

In all embodiments of the invention, it may be beneficial to leave all ports at the compression end closed after the end of the compression stroke while the piston begins the exchange stroke. The purpose of that maneuver is to balance pressure in the compression space to the level of pressure in the regenerators that are next to be communicated to the compression space. Similarly, at the end of expansion stroke, it may be desirable to close all ports at the expansion space end before the piston reaches the end of its travel, so as to build up pressure in the expansion space to the pressure in the regenerators that will next be communicated to the expansion space.

In all embodiments of the invention, the piston 4 and the cylinder 2 fit each other closely, or with minimal clearance, at each end, except in the recessed areas 40, 42, 44, 46. The fit between piston and cylinder wall must be tight enough to prevent serious leakage past the piston from one end of the cylinder to the other. That fit must also be tight enough to prevent gas leakage into or out of the ports 10, 12, 14, 16 except when they are opposite recessed areas 40, 42, 44, 46 of the cylinder or piston.

It is not necessary for the piston to make contact or maintain tight clearance with the cylinder wall over its entire length. Contact or tight clearance between piston 4 and the wall of the cylinder 2 at each end of the machine may be sufficient to provide sealing both for the valve ports and for the piston itself.

As is also true of Stirling and Ericsson cycle machines, Sibling Cycle machines must operate without lubricants in the expansion space, compression space or heat exchangers. To reduce friction between cams 92, 93 and cam followers 90, 91, low friction materials or anti-friction bearings should be used in the cam followers.

A collar of low-friction material mounted in the cylinder or a low-friction coating applied to the portion of the piston that makes contact with the cylinder wall will help to reduce friction. The cylinder wall may then be made of stainless steel, anodized aluminum or other appropriate material.

As illustrated in FIG. 5, it is not necessary for the diameter of the piston to be the same at both ends. In refrigeration applications, it is desirable for the expansion space swept volume to be smaller than the compression space swept volume.

A Sibling Cycle machine as shown in FIG. 1, FIG. 2 and FIG. 5 has no external heat exchangers other than the cylinder walls and cylinder heads. Since the interior surface area of the cylinder walls and cylinder heads will almost certainly be a very small fraction of the surface area of the regenerator matrix, adequate heat transfer to the inner surfaces of the cylinder walls and cylinder heads will be a problem, particularly in large machines. To enhance heat transfer, circular "isothermalizer" rings have been suggested by Martini and others. These are concentric rings, alternately attached to the piston face and to the cylinder head, meshing with a small clearance between them. They may be used with all embodiments of the invention and will be particularly advantageous when the regenerators are in the piston, as shown in FIG. 1, FIG. 2 and FIG. 5.

The gap between the isothermalizer rings permits radial gas flows between the relieved areas 40, 42 in the cylinder wall and the center of the piston face and the center of the cylinder head 72 along a labyrinthine path. Increasing the distance that the working gas must travel in order to equalize pressure throughout the expansion and compression spaces, respectively, increases the gas velocity, enhancing heat transfer. Similarly, reducing the width of the space through which the gas must pass reduces hydraulic diameter of the passage and increases heat transfer. Finally, increasing the surface area of the cylinder head improves heat transfer. These things are known.

However, there is an additional, new source of relative motion between working gas and the surface of the isothermalizer fins when the piston is rotated, as in the invention presented here. Where the bore of the machine is relatively large compared to its stroke, the relative gas velocity generated by rotation, particularly in the outer rings, becomes significant relative to the gas velocity resulting from the piston's reciprocation and heat transfer is enhanced.

As an engine, a Sibling Cycle machine requires some form of stored energy to carry it through the last part of the compression /expansion stroke, in which pressure on the compression side of the piston exceeds pressure on the expansion side, and through the return stroke. Kinetic energy stored in the rotating, reciprocating piston can provide at least some of that energy.

If the engine requires more energy to drive it through its cycle than the piston provides, it can be driven through part of the cycle by energy from an external source. If a mechanical drive is used, a flywheel connected to the crankshaft can supply that force. In electrical versions, electric power from any source can drive the piston through part of the cycle as in refrigerator/heat pump versions.

As indicated above, various alternatives to the embodiments of the invention described herein may be employed in practicing the invention. It is intended that the following claims define the invention and that devices and methods within the scope of these claims and their equivalents be covered thereby.

What is claimed is:

1. In a device of the Stirling Cycle type for converting energy between heat and work comprising:

compression and expansion chambers, means for decreasing the volume of one of the chambers while increasing the volume of the other chamber, gas storage means comprising first and second regenerator means, each connected to the expansion chamber and to the compression chamber, a quantity of compressible gas confined for circulation through the chambers and gas storage means, control means for communicating the first regenerator means only to the expansion chamber while communicating the second regenerator means only to the compression chamber and subsequently communicating the second regenerator means only to the expansion chamber while communicating the first regenerator means only to the compression chamber with intermediate steps of closing one of the regenerator means while exchanging fluid between the chambers through the other regenerator means, means for conducting heat into the expansion chamber, and means for conducting heat out of the compression chamber, the improvement comprising:

a double acting piston mounted for synchronous reciprocation and rotation for increasing and decreasing the volumes of the chambers through the reciprocation and for operating said control means through the rotation.

2. The device of claim 1 in which said control means comprises relieved areas in the periphery of the piston and ports in the walls of the chambers.

3. The device of claim 1 in which the control means comprise relieved areas in the walls of the chambers and ports in the periphery of the piston.

4. The device of claim 1 including synchronizing means for causing the piston to rotate one complete revolution for each four reciprocations of the piston.

5. The device of claim 1 in which said first and second regenerator means are located in the piston, and the control means comprises valve means in the walls of the chambers and valve means in the periphery of the piston communicating with the regenerator means.

6. The device of claim 5 in which the control means comprise relieved areas in the walls of the chambers and ports in the periphery of the piston.

7. The device of claim 5 in which a regenerator means in the piston periodically contains fluid confined at a pressure greater than the fluid pressure in the chambers.

* * * * *